United States Patent [19]

Brown

[11] 4,244,472

[45] Jan. 13, 1981

[54] STACKED SHIPPING UNIT

[75] Inventor: Philip H. Brown, Zionsville, Ind.

[73] Assignee: Inland Container Corporation, Indianapolis, Ind.

[21] Appl. No.: 45,753

[22] Filed: Jun. 5, 1979

[51] Int. Cl.[3] ..... B65D 19/00; B65D 21/02; B65D 71/00; B65D 85/62

[52] U.S. Cl. ..... 206/597; 206/511; 229/30; 229/DIG. 11

[58] Field of Search ..... 206/367, 511, 512, 597, 206/821, 598, 322; 229/DIG. 11, 30, 42, 35

[56] References Cited

U.S. PATENT DOCUMENTS

| | | | |
|---|---|---|---|
| 1,901,530 | 3/1933 | Pellymounter | 229/DIG. 11 |
| 2,620,117 | 12/1952 | Nemoede | 229/30 |
| 2,660,364 | 11/1953 | Ferguson | 229/35 |
| 2,684,766 | 7/1954 | Blom | 211/55 |
| 3,163,344 | 12/1964 | Tunick | 229/DIG. 11 |
| 3,240,385 | 3/1966 | Gits | 206/203 |
| 3,272,328 | 9/1966 | Krzyzanowski | 229/42 |
| 3,333,727 | 8/1967 | Belcher et al. | 206/509 |
| 3,348,673 | 10/1967 | Bahls et al. | 206/597 |
| 3,349,943 | 10/1967 | Box | 220/21 |
| 4,007,839 | 2/1977 | Stahl | 206/503 |

*Primary Examiner*—William T. Dixson, Jr.
*Attorney, Agent, or Firm*—Fitch, Even, Tabin, Flannery & Welsh

[57] ABSTRACT

A shipping unit which includes a rectangular pallet that supports a plurality of open-top trays which are individually filled with the products being shipped. The vertical, superimposed stack of filled trays is suitably united to the pallet by strapping, shrinkwrap, or the like. Each tray is formed from an integral corrugated fiberboard blank having a flat bottom and four upstanding peripheral walls which are interlocked with one another at each corner. The walls each have depending tabs that extend below the tray bottom and lie outward of and frictionally engage the product which fills the next lower tray.

5 Claims, 4 Drawing Figures

55
17
11
19
31
27
51
13

57
55
57
27
13

23
35
39
31
27
37
43
49
41
47

41
47
23
29
19a
35
25
43
37
15
31
21
27
19b
17
39
45
49

STACKED SHIPPING UNIT

The invention relates to fiberboard blanks for forming open-topped trays designed for use as a part of a stacked shipping unit and more particularly to a palletized shipping unit which includes a plurality of product-filled trays arranged in superimposed relation.

BACKGROUND OF THE INVENTION

Fiberboard, particularly corrugated fiberboard, provides an economical material for fabricating shipping containers for a wide variety of products. When relatively small items have been shipped in large bulk packs, they have often employed relatively deep corrugated containers wherein there was difficulty in placing and removing the lower layers. Smaller corrugated containers which totally enclose the product have been used to ship cans in loose pack form, for example, 24 cans of beer or soda; however, such containers require a fairly large amount of fiberboard relative to the product being transported. When products are utilized in subgroups, for example, a six-pack united by a wrapper or plastic connector, shallow trays of rectangular configuration are sometimes employed wherein the upstanding walls are interconnected by glued flaps. However, such shallow-tray arrangements have a tendency to slide when stacked one atop another and do not have the amount of stability desired even if interconnected by strapping or the like. Also, when using individual trays instead of a single bulk container, any desired total number of products may be unitized, as dictated by order size, desired stack height, carrier size, etc.

BRIEF SUMMARY OF THE INVENTION

An open-top tray is formed from a die-cut and scored fiberboard blank. When set up at the point of use, the tray has four upstanding walls which are hinged along the edges of a flat, rectangular bottom. The four walls may be interconnected by hinged locking flaps which are received in apertures cut in the adjacent wall; alternatively, the flaps could be stitched, glued or otherwise suitably locked to the adjacent wall. A plurality of die-cut tabs depend from each upstanding wall, and the blank is dimensioned so that the vertical height of the wall plus the tab is less than the height of the product being shipped. Accordingly, the depending tabs lie in the plane of the vertical walls and frictionally engage the outer surfaces of the product along its upper edges. An extremely stable stack of product-filled trays is thus achieved which can be suitably unitized upon a pallet.

DETAILED DESCRIPTION OF THE PREFERRED EMBODIMENTS

Figure 1:
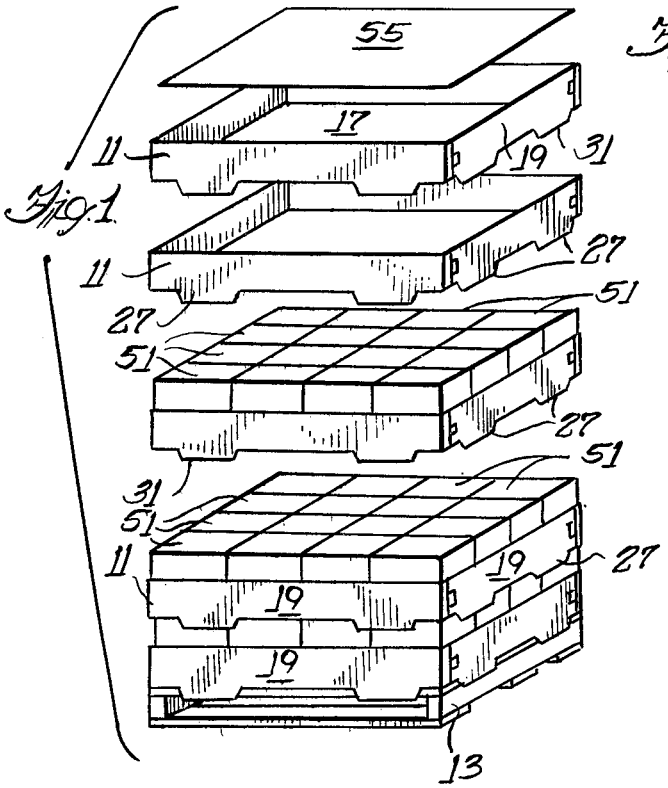
FIG. 1 is an exploded perspective view showing a plurality of fiberboard trays embodying various features of the invention with some of the trays shown loaded with product and arranged in a vertical, superimposed stack.

FIG. 1 depicts five fiberboard trays 11 arranged in superimposed relationship with three of the trays being filled with product. The lowermost tray 11 is shown resting upon a wooden pallet 13, and the trays and the pallet are proportioned so as to be of the same rectangular size.

Figure 3:
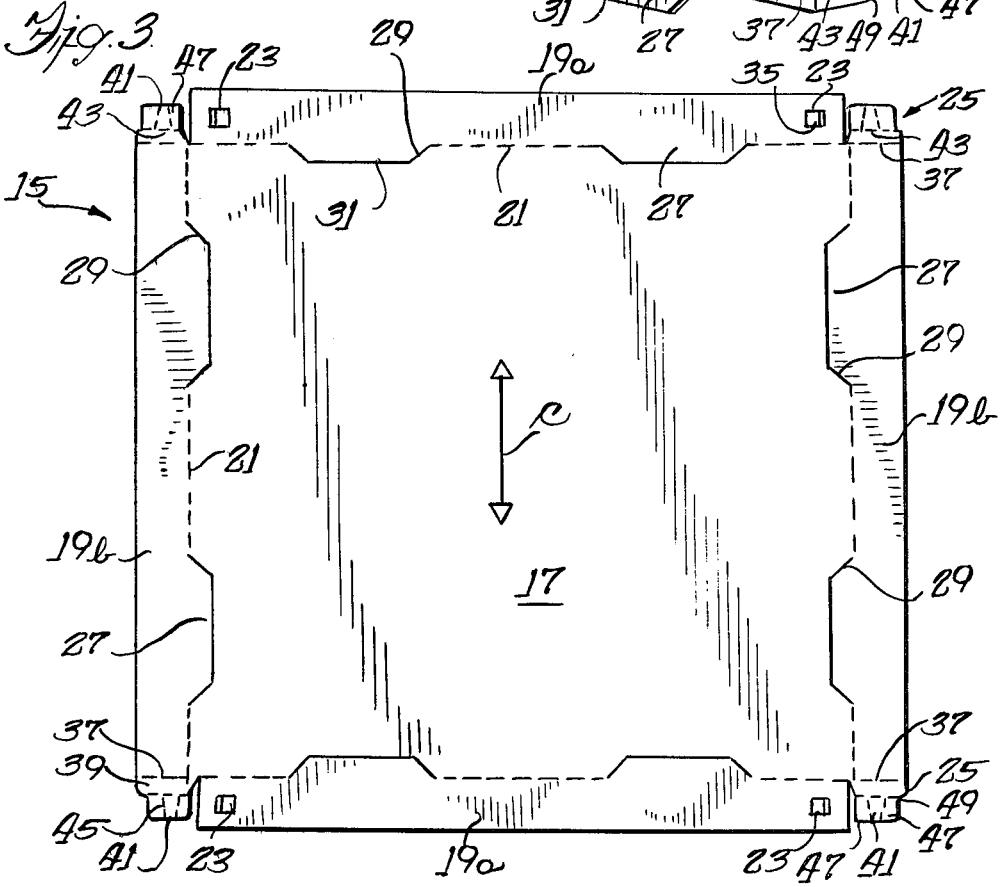
FIG. 3 is a plan view of a fiberboard blank which has been die-cut and scored in a manner to permit its folding for set-up as one of the open-top trays; shown in FIG. 1.

Shown in FIG. 3 is a fiberboard blank 15 from which the tray 11 is easily set up. The blank 15 is die-cut from corrugated fiberboard, which may be C-flute singlewall or may be doublewall corrugated board, wherein the direction of the flutes is preferably as indicated by the arrow C. This flute direction aids in ease of setting up of the interlocking corners, as explained hereinafter.

The die-cut and scored blank 15 includes a central generally rectangular bottom panel 17 which is surrounded by four straight walls 19 which are hinged thereto generally along score lines 21. In the illustrated embodiment, opposite walls are duplicates of each other, with the walls **19*a* containing apertures or slots 23 and with walls 19*b* having hinged flaps 25** provided at each end.

Each of the four walls 19 is formed with a pair of elongated ears or tabs 27 which depend therefrom and which are formed by a die-cut slit pattern 29 which interrupts the score lines 21. Accordingly, the tabs 27 are carved out of the central rectangular region that would otherwise be a part of the bottom panel 17. The lower edge 31 of the tabs 27 is preferably parallel to the upper straight edge of each wall 19, and the ends of the tabs are cut diagonally on a 45° angle ±10°, for example. Each pair of tabs 27 is spaced apart from each other and is located generally adjacent the respective ends of each wall. A larger number of tabs 27, e.g., 3 or 4, could be used along each wall.

Figure 4:
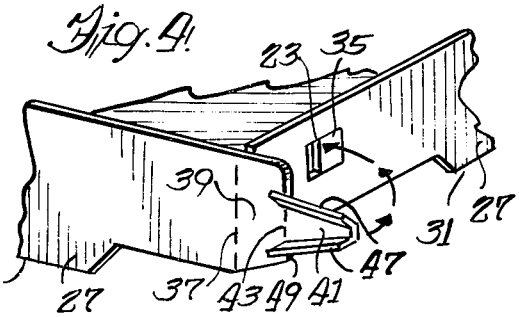
FIG. 4 is a fragmentary perspective view, enlarged in size, illustrating the interlocking tab and slot arrangement at a corner of the tray formed from the blank of FIG. 3.

As best seen in FIG. 4, the adjacent ends of the walls 19 are formed with an interlocking or interengaging tab and slot arrangement designed to facilitate their interconnection in an upstanding perpendicular arrangement without the need of outside fasteners, such as staples or the like. The walls **19*a* are each formed with apertures or slots 23 spaced a predetermined distance from each end. The apertures 23 are generally rectangular in shape and are die-cut so that a slightly shorter keeper flap 35** is hinged to the inner edge of the aperture.

Hinged along a score line 37 to each end of the walls **19*b* is the flap assembly 25 which includes a short panel 39 at the end of which is a foldable tab 41 hinged along a parallel score line 43. The distance between the score lines 37 and 43 is approximately equal to the distance which the edge of the rectangular aperture 23 is spaced from the end of the wall 19*a*. The tab 41 which is hinged to the short panel 39 along the line 43 is defined by a pair of converging score lines 45 which create two sections 47 that flank the central tab section and are severed from the short panel 39 by slits 49 which are aligned with the score line 43. The width of the central tab section is about equal to the height of the aperture 23 through which it is inserted, and the converging score lines 45 allow the flanking sections 47 to be folded as shown in FIG. 4** for easy insertion.

The die-cut blanks 15 are shipped to the plant of the user in flat condition and, when needed, are easily manually set up. One or both of the walls **19*a* containing the apertures 23 is first folded 90° to its upstanding position, and as a result of this folding the depending tabs 27 project below the undersurface of the bottom layer 17. One of the walls 19*b* is folded 90° to achieve the orientation depicted in FIG. 4. The flanking sections 47 of the tab are folded back along the converging score lines 45, and by bending the tab along the score line 43 and the short panel 39 along the score line 37, the free end of the folded tab is caused to enter the rectangular aperture 23. The tapered design allows it to be easily pushed through, past the hinged keeper 35, and once fully inserted through the wall 19*a* of the tray, the natural resiliency of the corrugated board causes the flanking sections 47 to spring back to their generally planar arrangement and locks the two walls together at the corner in mutually perpendicular orientation. The outward return of the flanking sections 47 plus the keeper 35** assures that the corner lock cannot be inadvertently disengaged.

The other three corners of the tray 11 are easily interlocked in the same manner, and the tray is then free-standing and ready to be filled. Preferably the empty tray 11 is loaded on an empty pallet 13, and the products 51 are then loaded into the body of the tray, filling the region between the four upstanding walls 19. The depending tabs 27 fit outside the edge of the pallet 13 as depicted in FIG. 1. The tray 11 is particularly suitable for shipping products 51 which are close in shape to that of a rectangular parallelpiped, for example, the molded, hard rubber casing of an automobile battery. In the illustrated arrangement, sixteen such battery casings 51 are loaded into the open-top tray 11 in four rows of four each.

When the first tray is filled, a second set-up tray is located atop the filled bottom tray, and it fits snugly into place because the depending tabs 27 frictionally engage the outer upper edges of the battery cases 51 therebelow. As can be seen from FIG. 1, it is important that the height of the vertical wall 19 plus the height of the depending tab 27 is less than the height of the product 51 being packaged. As a result, assuming that the tray 11 is proportioned to snugly hold a given number of products 51 of a regular shape within the body portion of the tray, the dependent tabs 27, which lie in the same vertical planes as the upper portions of the vertical walls 19, will also snugly interfit around the upper edges of the products. Because of the greater height of the product 51 as just mentioned, the lower edges 31 of the depending tabs 27 will be spaced from the upper edge of the next lower tray 11, and there is no interference therebetween, as seen in FIG. 1.

After the second tray is filled, a third tray is set up and located in place, and the filling process is repeated. Because of the stability which is provided by the frictional interfitting of the trays 11 about the upper edge of the product array, a stack of filled trays can be built up to substantially any desired height as convenient for handling and/or shipping purposes. Five layers of filled trays 11 are simply illustrated as an example.

Figure 2:
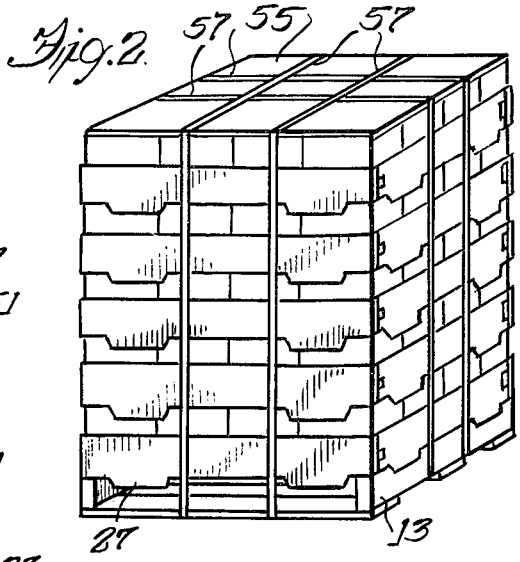
FIG. 2 is a perspective view showing the completed stack depicted in FIG. 1 with all five trays filled and unitized upon a pallet.

Once the desired number of layers of filled trays 11 are in place on the pallet 13, a rectangular pad 55 of corrugated board is preferably placed atop the stack. With everything in place, two pairs of straps or bands 57 are then looped about the stack at 90° to each other, as depicted in FIG. 2, and then tightened to secure the stack to the pallet 13 and create a unit ready for transportation. Although bands 57 are shown, stretchwrap or shrinkwrap film can also be used.

Although the invention has been described with regard to a particular preferred embodiment, it should be understood that various modifications and changes which would be obvious to one having the ordinary skill in the art may be made without departing from the scope of the invention which is defined by the appended claims. For example, each of the walls 19 could be provided with an aperture at one end and a tab or ear arrangement at the other end, or some equivalent type of interlocking arrangement could be employed. The corner construction could also be varied slightly to blunt the corner edge if shrink film is to be used. Moreover, depending upon the product being shipped, it might be possible to employ the tray with an upside-down orientation—with the inverted tray located over the product array and with the locating tabs or ears extending upward.

Various features of the invention are emphasized in the claims which follow.

What is claimed is:

1. A shipping unit which comprises a rigid generally rectangular supporting base, a plurality of open-top free-standing trays formed of fiberboard sheet material, product to be shipped filling each of said trays, and said filled trays being arranged in vertical superimposed relationship, means uniting said filled superimposed trays to said base, and each of said free-standing trays being formed from an integral fiberboard blank and having a flat bottom and four upstanding interconnected vertical walls defining its periphery, means formed in the four corners of said blank which locks adjacent ends of said walls generally perpendicular to one another and upstanding from said flat bottom, said locking means including a locking flap hinged to the end of one of each pair of adjacent walls and interengaging means formed in said locking flap and in the other of said pair of adjacent walls, and said vertical peripheral walls each having depending ears which extend below said bottom and lie outward of and frictionally engage the product filling said next lower tray, the height of said wall plus said depending ear being less than the height of said product, said ears being formed of fiberboard material from the region of said blank otherwise constituting said flat bottom.

2. A shipping unit in accordance with claim 1 wherein aperture means is formed in said other adjacent wall near the end thereof, said locking flap including a tab formed therein which extends through said aperture means and locks said walls together at the corner.

3. A shipping unit in accordance with claim 1 wherein each wall includes at least two depending ears, each located generally adjacent opposite ends of said wall.

4. A shipping unit in accordance with claim 3 wherein each of said depending ears has a lower edge parallel to the upper edge of said wall from which it depends.

5. A one-piece corrugated fiberboard blank for forming a free-standing open-top tray designed for use as one of a plurality of open-top trays which when filled with product are stacked in vertical superimposed relationship atop a rigid generally rectangular supporting base, said blank being die-cut and scored to provide a central, generally rectangular bottom panel and four wall panels respectively hinged along a score line at one of the four edges of said bottom panel, interlocking means formed in said blank by die-cuts which means is effective to lock together adjacent ends of said walls in perpendicular relationship to one another and upstanding from said bottom, said interlocking means including a locking flap hinged to the end of one wall panel at each of the four corners of said blank and including interengaging means formed in said flap and in the other wall panel at said corner whereby said blank can be set-up to free-standing orientation without the need of fasteners, and said score lines which define said four walls being interrupted by die-cut slits which extend into the region of said bottom panel and define depending ears which extend from the lower edge of each wall and below said bottom panel and which ears lie outward of and frictionally engage the product which fills the next lower tray when arranged in a stack, the height of said wall plus said depending ear being less than the height of the product carried in said tray.

* * * * *